US006922870B2

(12) United States Patent
Tontz, Sr.

(10) Patent No.: US 6,922,870 B2
(45) Date of Patent: Aug. 2, 2005

(54) TORQUE MAGNIFYING HANDLE FOR DRIVING TOOL

(76) Inventor: William L. Tontz, Sr., 4060 4th Ave., San Diego, CA (US) 92103

( * ) Notice: Subject to any disclaimer, the term of this patent is extended or adjusted under 35 U.S.C. 154(b) by 0 days.

(21) Appl. No.: 10/460,146

(22) Filed: Jun. 11, 2003

(65) Prior Publication Data

US 2004/0250378 A1 Dec. 16, 2004

(51) Int. Cl.[7] ..... A47B 95/02

(52) U.S. Cl. ..... 16/110.1; 16/421; 16/422; 81/177.5; 81/177.4

(58) Field of Search ..... 16/421, 422, 426, 16/427, 110.1; 81/177.5, 177.4, 490

(56) References Cited

U.S. PATENT DOCUMENTS

| | | | | | |
|---|---|---|---|---|---|
| 226,582 | A | * | 4/1880 | Miller | 81/124.4 |
| 1,420,279 | A | * | 6/1922 | Parsons et al. | 81/177.2 |
| 1,578,065 | A | | 3/1926 | Bemus et al. | |
| 1,578,114 | A | | 3/1926 | Fegley | |
| 2,475,268 | A | | 7/1949 | Wittle | |
| D159,482 | S | * | 8/1950 | Garbs | D8/87 |
| 2,569,069 | A | | 9/1951 | Motel | |
| 2,725,086 | A | | 11/1955 | Keyes et al. | |
| 2,821,403 | A | | 1/1958 | Bevan | |
| 2,950,746 | A | * | 8/1960 | Towne | 81/177.1 |
| 3,340,914 | A | | 9/1967 | Ricks | |
| 3,356,117 | A | * | 12/1967 | Wagner | 81/33 |
| 3,672,419 | A | * | 6/1972 | Fischer | 81/460 |
| 3,752,202 | A | * | 8/1973 | Condon | 81/436 |
| 3,850,056 | A | | 11/1974 | ALlen | |
| 4,056,020 | A | * | 11/1977 | Coviello | 81/177.2 |
| 4,417,611 | A | | 11/1983 | Kim | |
| 4,440,048 | A | | 4/1984 | Stevens et al. | |
| 4,640,155 | A | | 2/1987 | Condon | |
| D298,101 | S | | 10/1988 | Chen | |
| 4,996,896 | A | | 3/1991 | Bachand et al. | |
| 5,257,557 | A | | 11/1993 | Battten | |
| 5,285,543 | A | * | 2/1994 | Rowe | 7/138 |
| 5,289,743 | A | | 3/1994 | Cirami | |
| 5,335,409 | A | | 8/1994 | Elvebak | |
| 5,960,987 | A | | 10/1999 | Solland et al. | |
| 6,089,133 | A | | 7/2000 | Liao | |
| 6,378,402 | B1 | * | 4/2002 | Kalomeris et al. | 81/177.5 |
| 6,532,846 | B2 | | 3/2003 | Lin | |

FOREIGN PATENT DOCUMENTS

| | | |
|---|---|---|
| WO | WO 99/56916 | 11/1999 |

* cited by examiner

*Primary Examiner*—Suzanne Dino Barrett
*Assistant Examiner*—Mark Williams
(74) *Attorney, Agent, or Firm*—Gordon & Rees LLP; Harris Brotman

(57) ABSTRACT

A handle which is sized for gripping and for holding a drive tool wherein the drive-tool handle can be alternately positioned in the body of the handle for achieving varying amounts of torque. As assembly involving the handle and the drive tool.

8 Claims, 2 Drawing Sheets

TORQUE MAGNIFYING HANDLE FOR DRIVING TOOL

BACKGROUND OF THE INVENTION

1. Field of the Invention

The invention is directed to a handle for manipulating a drive-tool, and more particularly to a handle for imparting selected levels of torque to a drive tool by virtue of the position of the drive-tool in the handle.

2. Description of Related Art

Various mechanisms are in use for interlocking a driven tool, such as a screw driver, a socket, or a drill bit, in a handle for applying torque to the driven tool. Hand tools are available in which an implement may be selectively mounted upon the handle in different orientations for improving dexterity, ease of use or increasing torque.

Where the drive tool such as the screw-drive blade is held by the handle at the axial end of the handle, it is often difficult to develop sufficient leverage to drive the fastening element to either secure the fastening means or to dislodge the fastening means. One needs to use a different tool.

It is also not convenient to have a tool which is operable only from one end since there are times when because of space requirements it would be handy to have a tool in which the fastening element can be secured at a different location of the tool. A tool capable of accepting a drive tool in alternative configurations and which increases the torque at the operative end of the tool would be desirable. The present invention provides a tool in which the torsion value of the drive-tool is increased by the handle.

SUMMARY OF THE INVENTION

The invention involves a handle for holding a drive tool in alternate configurations, the drive tool having a drive-tool handle. The handle has a body which is sized for hand gripping. The body has a longitudinal axis and a transverse axis. Formed in the body is a longitudinal bore, which has a cross section, extending from a first opening to a second opening in the body. A transverse bore extends from an opening in a side wall of the body and intersects the longitudinal bore. The longitudinal and transverse bores have cross-sectional configurations which are complementary to the cross-sectional configuration of the drive tool handle. Formed about the second opening is a stop member. Inserted into either the first opening, the second opening, or the transverse opening, the drive tool handle becomes non-rotationally engaged with the walls of the bore in an assembly. In another aspect, the invention is directed to an assembly which comprises the handle and the drive tool.

The above-discussed and many other features and attendant advantages of the present invention will become better understood by reference to the following detailed description of the invention taken in conjunction with the accompanying drawings

DISCLOSURE OF THE INVENTION

Figure 1:
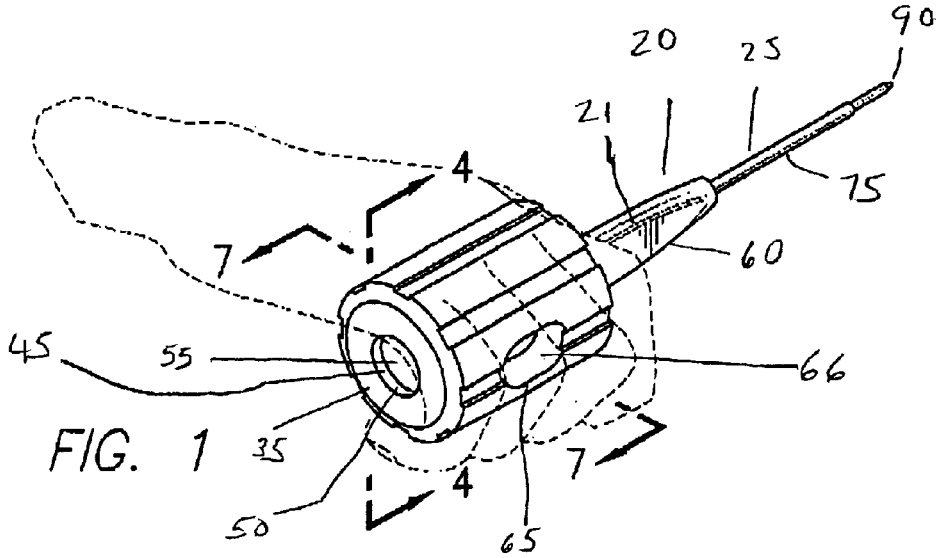
FIG. 1 is a perspective view of a first assembly of the handle and the drive tool.

The invention involves a handle 10 in which a shank-type tool 20 (e.g. screwdriver) is selectively mounted in different orientations thereto for improving dexterity, ease of use, and magnifying torque. In another aspect, the invention includes a hand-grippable fastening tool comprising the handle of the invention in combination with a drive-tool 11.

As detailed below, a drive-tool 20 may be mounted in three alternative operative positions on the handle, two of the positions in a coaxial manner. The coaxial positions provide ease of rapidly rotating the tool with fine control. A third position permits maximum torque to be manually applied to the drive-tool 20.

The Handle

The handle 10 of the invention has a body 15 which is configured for receiving a drive tool 20. The drive tool is typically in the form of a screwdriver having a shank or blade 25. It is understood that the drive-tool handle 21 may be the handle of any hand tool which is operated by rotating about an axis which extends lengthwise (22) or transversely (23) from the drive-tool handle, and in which the user grips the handle to exert both the axial and torque forces required for the tool's operation.

The shape of the handle 10 is intended to fit the contours of the hand in grasping the handle. The handle has a generally annular cross-section. However, rectangular or polygonal configuration are equally plausible for esthetic or functional purposes. Annular shape or a generally annular shape, which in some embodiments is "molded" for receiving the user's grip, is preferred.

An elongate body may have a cylindrical configuration, its outer surface or side wall 17 provided with knurls 30 or longitudinal ridges to facilitate gripping of the handle. Any non-slide, gripping material is provided on the handle to facilitate the gripping. Alternatively, the handle may be formed of various materials and given surface treatment to enhance the grippability of the handle.

The handle may be formed of any suitable material. Although the materials from which the handle, the driver tool are not critical, there are certain preferred materials. The handle may be machined or molded of metal or plastic. Metal is preferred for strength.

Each end of the handle comprises a face 35 in which an opening (40, 45) is formed. A longitudinal or axial bore 37 extends from end to end forming respective first 40 and second 45 openings in the faces 35.

A lip or stop shoulder 50 is formed in or near said second opening 45. The circumference of the longitudinal bore 37 in the region of the lip or stop shoulder 50 is reduced sufficiently to stop the rear end 55 of the drive-handle 21 or to wedge the front region 60 of the tapered drive handle 21, in effect, obstructing the travel of the front region 60 through the longitudinal bore 37.

A transverse bore 66 extends from a from a side wall opening 65 of the body 15. The transverse bore 66 intersects the longitudinal bore 37. In one aspect, the transverse bore 66 extends to an end wall which is the apposite wall 75 of the longitudinal bore 37. In preferred embodiments, the transverse bore 66 terminates in a seat 70 formed in the apposite wall and shaped to fittingly receive the rear end 55 of the drive-tool handle 21.

The intersection 80 of the longitudinal 37 and transverse 66 bores is positioned in the midpoint of the handle to provide a balanced effect, although the intersection may be positioned eccentrically for specialized torquing effects.

As set forth below, the bores may be given any number of cross-sectional configurations such as square, hexagonal, octagonal, and the like. In relation to the cross-sectional configuration of the bores, the drive-tool handle 21 has a cross-sectional configuration complementarily shaped for insertional mating with the bore with and traveling therein. The provision of complementary cross sectional configurations enables a non-rotatable fit between the drive-tool handle and a bore of the handle, and hence is preferred. The openings of the longitudinal bore and the transverse bore are of sufficient dimension and of sufficient depth to accept the drive-tool handle.

The Drive-Tool

The drive tool 20 comprises a drive-tool handle 21 which has a front end 85, a front portion 60, a rear portion 61, and a rear end 55.

The drive-tool comprises an axially extending shank 75 or implement portion having a working end 90 configured and dimensioned so as to be complementary to a fastening element, such as a screw.

The drive tool handle 21 is held non-rotatably and releasably retained within a bore by means of the cooperation of the complementary cross-sectional configurations of the drive-tool handle and bore. The mating cross-sectional configurations of the bores and the drive-tool handle are such that the non-rotable fitting of the drive-tool handle with a bore will not loosen under the forces developed by the user when torque is applied to the drive-tool by virtue of the leverage at the other end of the tool. Thus, the drive-tool handle is adapted in shape and size to fit with the respective longitudinal or transverse bore, to be non-rotably and releasably held therein.

The implement portion of the drive tool, e.g. a shank or blade 25, 75 extends axially from the front end 85 of the drive tool handle. In the embodiment, the blade is round in cross-section.

The working end 90 of the blade 25 which is used to turn screws may be provided with a wedge-like tip to fit a kerf in the head of a screw, or the end of the blade may have a cross-like tip to fit the head of a Phillips screw. Alternatively, the working end may be configured for fitting with fastening elements which may be hex-heads or star-bedded, multi-pronged. The blade may also be used to turn nuts and bolts by assembling a socket over the lower end of the blade. Among the tools for use with the handle are augers, bits, wrenches and other tools having shanks.

In the embodiment shown, the drive tool handle is rectangular in cross section, as are cross-sections of at least a portion of the length of the bores into which the drive tool handle is inserted. It will be understood, of course, that if desired, the handle need not be provided with openings that have identical cross-sectional configurations as the drive-tool handle so long as a sufficient length of the bore is provided with a cross-sectional configuration complementary with the cross-sectional configuration of the drive-tool handle to result in a non-rotatable fit.

In an embodiment, all or a portion of the drive tool handle may be tapered, which, in the second assembly described below, allows a length of the drive-tool handle to project from the first 40 and the second 45 opening. Intermediate the front and rear ends of the drive-tool handle, there is formed a front region 60 of cross-sectional dimensioned smaller than the rear region of the drive-tool handle. The front region of the drive tool handle is configured and dimensioned to be stopped by the lip 50 placed at or near the second opening 45 as illustrated in the second assembly below. In any case, the front end 85 or a cross-section of the front region 60 of the drive-tool handle 21 is configured to be stopped by the lip 50 at or near the second opening 45. The position of the lip or stop shoulder either defined by the second opening 45 or provided in the longitudinal bore near the second opening limits in the first assembly (FIGS. 1, 4) the distance which the rear end 55 of the drive-tool handle can be inserted into the longitudinal bore; and limits in the second assembly (FIGS. 2, 5) the distance which the front region 60 of the drive-tool handle projects from the second opening 45.

Assembly and Use

In alternate assemblies, the drive tool handle is selectively disposed in either the first opening or in the transverse or side wall opening depending upon the desired amount of torque. There are three alternative assemblies involved in the combination of the handle and the drive-tool handle. With the drive tool disposed in the longitudinal bore (First or Second Assembly, FIGS. 1, 4 and 2, 5, respectively), the drive-tool handle assumes a coaxial position more like that of an ordinary screwdriver handle with relation to the tool shank. In a third assembly (FIGS. 3, 8), the rear end 55 of the drive-tool handle is inserted in the transverse bore. A T-shaped configuration is formed between the handle and the drive-tool handle.

Accordingly, the handle's torque against the drive-tool handle, i.e. the torsion value of the handle, depends on the position of the drive-tool handle in the handle.

The handle is intended to be grasped in the palm of the hand with the hand clenched about the handle.

First Assembly—Intermediate Torque Control

Figure 7:
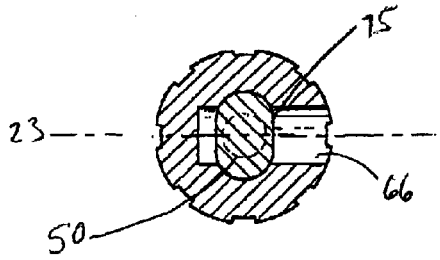
FIG. 7 is a cross-sectional view taken along lines 7—7 of FIG. 1.

In a first assembly (FIGS. 1, 4), the user inserts the rear end 55 of the drive-tool handle 21 into the first opening 40 until the rear end of the drive-tool handle is obstructed by lip 50 formed in the second opening 45. The lip forms a stop against which the rear end or rear region 61 of drive-tool handle abuts or wedges. The complementary fit of the drive-tool handle in the longitudinal bore adequately holds the drive-tool handle, which permits a non-rotatable fit between the drive-tool handle and the longitudinal bore. As can be seen most clearly in FIG. 7, a sufficient portion or portions of the longitudinal bore are cross-sectionally configured to be in cooperation with the cross section of the inserted drive-tool handle to render the drive-tool handle removeably engaged and non-rotatable relative to the handle.

Figure 4:
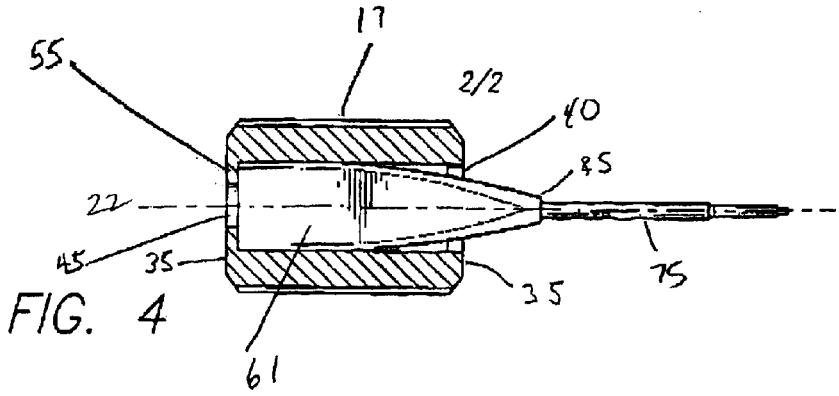
FIG. 4 is a cross-sectional view taken along lines 4—4 of FIG. 1.

The user firmly grips the outer wall 17 of the handle, preferably an outer wall provided with non-slip ribs to facilitate a good grip. With the drive-tool and handle assembled as shown in FIGS. 1 and 4, the user applies torquing pressure to turn the blade or shank in mating configuration with a fastening element, for example, a screw.

Second Assembly—Fine Control

Figure 2:
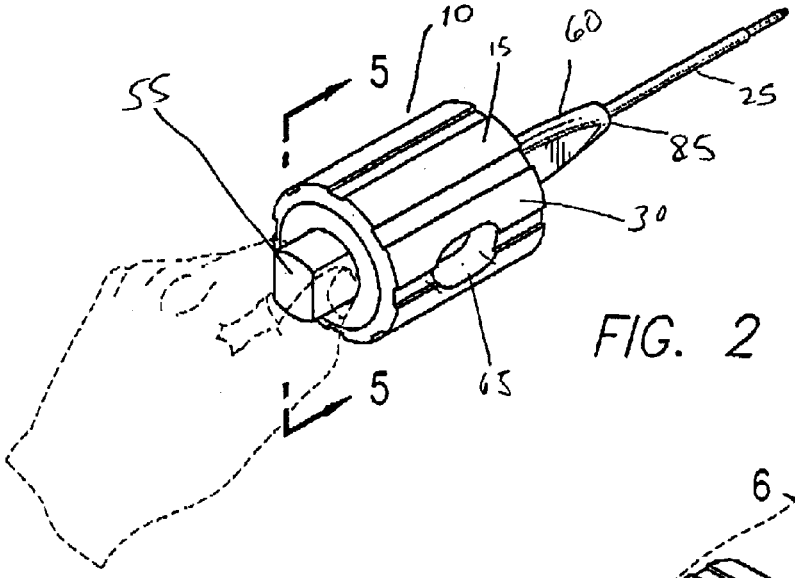
FIG. 2 is a perspective view of a second assembly of the handle and the drive tool.
Figure 5:
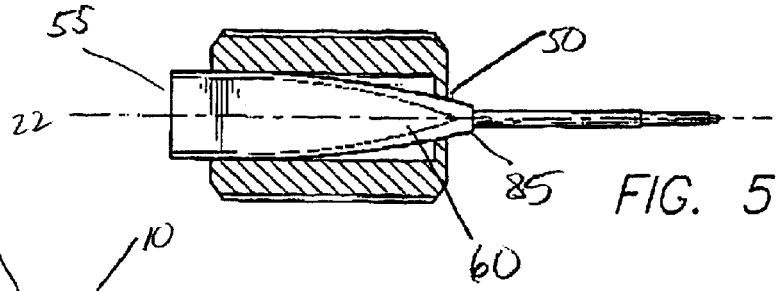
FIG. 5 is a cross-sectional view taken along lines 5—5 of FIG. 2.
Figure 6:
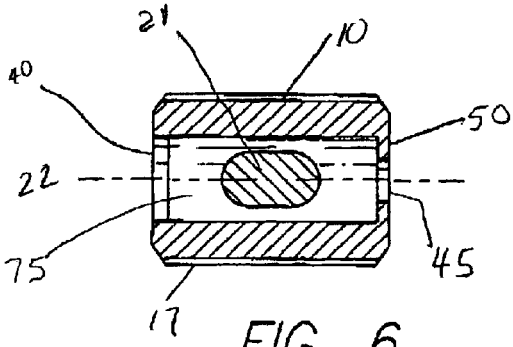
FIG. 6 is a cross-sectional view taken along lines 6—6 of FIG. 1.

In a second assembly (FIGS. 2, 5), one inserts the working end of the blade or shank into the first opening until the front end 85 of the drive-tool handle abuts the lip 50 or, in embodiments in which the drive tool handle is tapered, a lesser dimensioned circumference of the tapered front region 60 wedges in the lip or stop shoulder. The complementary fit of the drive-tool handle in the longitudinal bore adequately holds the drive-tool handle, which permits a non-rotatable fit between the drive-tool handle and the longitudinal bore. While stabilizing the assembly with one hand, the user's other hand firmly grips the portion of the drive tool handle extending from the second opening 45. With the drive-tool and handle assembled as shown in FIGS. 2 and 5, the user applies to the drive tool handle (i.e. the portion extending from the second opening 45) torquing pressure to turn the blade or shank in mating configuration with, for example, a screw. The second assembly is a fine adjustment position in which the user applies torquing force by grasping and manipulating the rear portion of the drive tool handle.

The front region 60 of the drive-tool handle may have a reduced or tapered section against which the lip 50 wedges the drive-tool in a position in which an intermediate length of the drive-tool handle is disposed within the longitudinal bore and the front portion and rear portion of the drive-tool handle project, respectively, from the second hole and the first.

Third Assembly—Maximum Torque

Figure 3:
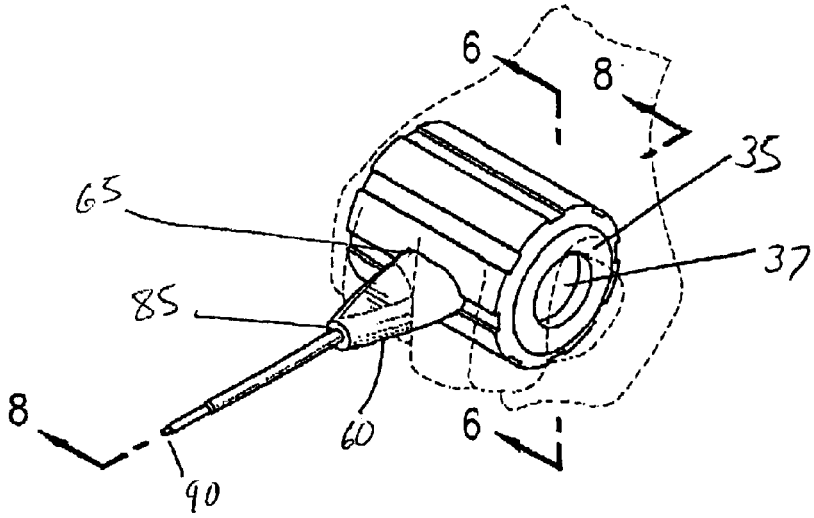
FIG. 3 is a perspective view of a third assembly of the handle and the drive tool.
Figure 8:
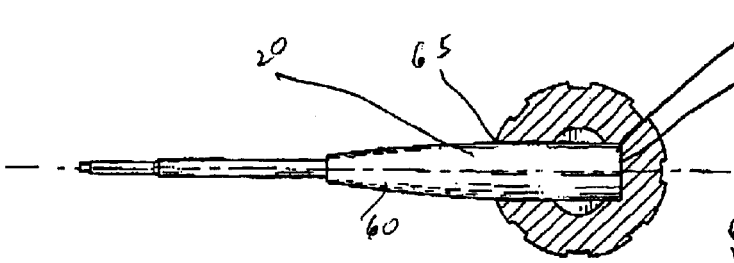
FIG. 8 is a cross-sectional view taken along lines 8—8 of FIG. 3.
Figure 9:
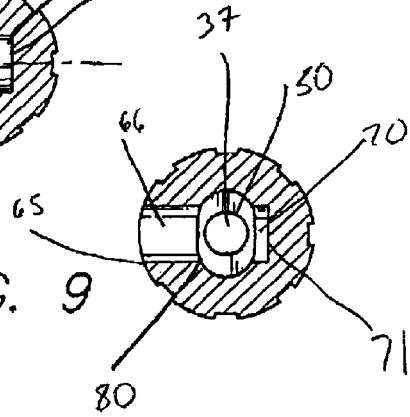
FIG. 9 is a cross sectional view of the handle without the drive tool taken along lines 8—8 of FIG. 3.

When it is desired that the greatest torque be produced by the implement, the rear end 55 of the drive-tool handle 21 is inserted into the transverse opening 65 in the fashion of a third assembly (FIGS. 3, 8). Placed in the transverse bore 66 through the transverse opening 65, the drive-tool forms a T-shape with the handle 10. One inserts the rear end of the drive-tool handle into the side wall opening 65 of the transverse bore 66 until the rear end of the drive tool handle abuts the apposed wall 75 of the longitudinal bore. Preferably a seat is formed in the apposite wall for accepting and stabilizing the rear end of the drive tool handle The complementary fit of the drive-tool handle in the transverse bore adequately provides a non-rotatable fit between the drive-tool handle and the longitudinal bore.

In a preferred embodiment, a seat 70 is formed in the terminal end 71 of the transverse bore 66. The seat forms a stop against which the rear end of the drive-tool handle abuts. The pressure of the rear end of the handle against the seat adequately keeps the drive-tool handle assembled with the handle. The complementary fit of the rear end of the drive-tool handle in the seat holds the drive-tool handle, which permits a non-rotatable fit between the drive-tool handle and the seat. The user firmly grips the outer wall of the handle, preferably the outer wall provided with non-slip ribs to facilitate a good grip. With the drive-tool and handle assembled as shown in FIGS. 3 and 8, the user applies torquing pressure to turn the blade or shank in mating configuration with, for example, a screw.

In another aspect, the invention includes a combination of the handle described herein in cooperation with a drive tool handle. The combination is referred to herein as an assembly. The drive-tool handle is dimensioned and formed with a cross-sectional configuration which is complementary to the cross-sectional configurations of the bores as set forth above in first, second, and/or third assemblies.

EXAMPLE

An embodiment of the handle involves a handle 10 adapted in shape for use in orthopedic surgery. Specifically, the torque enhancing handle 10 was used with a drive tool known as the small fragment A.O. Screwdriver 20 which has a drive-tool handle measuring about ¾ inch on the circular portion by ½ inch on the flat portion (FIGS. 1, 2, 3, 4, 5, 8). In repairing bone fractures, an orthopedic surgeon uses the A.O. Screwdriver in combination with orthopedic screws to fasten plates to bones with screws. Orthopedic tools and fastening elements were obtained from Biomet Orthopedics, Inc., San Diego, Calif.; and/or Synthes Co., Paoli, Pa.

The A.O. Screwdriver as well as the screws (3.5 A.O. screws) are small. In use with larger bones, i.e. pelvis and acetabulum and tibial plateau and femur fractures, more torque is required than for use with the smaller bones for which the A.O. screwdriver was originally intended. A complete description of the A.O. screwdriver and its use is contained in the A.O. Manual.

Prior to the invention of the handle disclosed herein, surgeons wrapped cotton absorbing sheets (lap packs) around the screwdriver handle to enhance its torque capabilities. The problem with lap packs is that they do not grasp the handle well, easily slide, get caught in the wound, and make it difficult for the surgeon to provide the torque necessary to tighten down screws within the pelvis, or around the knee or larger bones. An advantage of the handle invention disclosed herein is that it provides for finer manipulation of screws when starting, yet makes it easier for the surgeon to apply, when needed, more torque with less fatigue on the surgeon's hand, and allows for reproducible tightening of the plates in the pelvis, the larger bones, and even small fragment bones. With less fatigue and greater ease of application of screws in the operating room, there is a decrease in operative time and blood loss, and better fixation for the fractures involved.

In operation, the drive-tool handle of the A.O. Screwdriver is inserted according to one of the assemblies described above to provide enhanced torque for tightening screws. In the first assembly position (FIGS. 1 and 4), the rear end of the screwdriver handle is inserted into the first opening of the handle, travels in the longitudinal bore until stopped by the lip at the second opening.

In the second assembly position (FIGS. 2 and 5), the user inserts the working end of the shank of the drive tool into the first opening. The drive-tool handle travels in the longitudinal bore until the front region of the drive tool handle is stopped by wedging against the lip so that the screwdriver handle projects from the first and second openings. In this position, the handle permits fine digital control of the screwdriver in tightening down the screw, and then the surgeon's hand can be placed over this to further tighten the screw once the fine tightening has been done.

In the third assembly position (FIGS. 3 and 8), the T-position, the handle is typically held in the surgeon's hand, the screwdriver mounted in the transverse bore and located between the 3rd and 4th fingers. This is the high-torque position.

Readers of skill in the art to which this invention pertains will understand that the foregoing description of the details of preferred embodiments is not to be construed in any manner as to limit the invention. Such readers will understand that other embodiments may be made which fall within the scope of the invention, which is defined by the following claims and their legal equivalents.

What is claimed is:

1. A handle for a drive tool, said drive tool comprising a drive-tool handle having a rear end and a tapered front region, said handle comprising:

a. a body sized for gripping and having a longitudinal axis and a transverse axis;

b. a longitudinal bore having a cross-section and extending coaxially and forming first and second openings at each end of said body;

c. a transverse bore having a cross-section and extending from an opening in a side wall of said body, intersecting said longitudinal bore, and terminating in the opposite wall of the longitudinal bore;

d. a sole stop member formed in said body, said stop member formed about said second opening, said stop member dimensioned to obstruct insertion of the rear end of the drive tool handle through the second opening and for non-rotational engagement of the tapered front region of the drive tool handle with the longitudinal bore, wherein a sufficient length of the cross-sectional configurations of said bores are generally complementary in cross-sectional configuration and dimension for removable, non-rotational engagement of the drive-tool handle with either the longitudinal bore through said first opening or the transverse bore through said transverse opening and wherein said drive tool handle is alternatively positionable in said handle by inserting the rear end or the tapered front region of the drive tool handle in said first opening, or by inserting the rear end of the drive tool handle in said transverse opening.

2. The handle of claim 1 wherein non-slippery material or gripping members are formed on the surface of the body.

3. The handle of claim 1 wherein said drive tool is a screwdriver.

4. The handle of claim 1 wherein the body has a cross-section shaped for hand gripping which is selected from the group of cross-sections consisting of annular, generally annular, and polygonal.

5. An assembly comprising:

a. a handle for a drive tool, said drive tool comprising a drive-tool handle having a rear end and a tapered front region, said handle comprising i. a body sized for gripping and having a longitudinal axis and a transverse axis;

ii. a longitudinal bore having a cross-section and extending coaxially and forming first and second openings at each end of said body;

iii. a transverse bore having a cross-section and extending from an opening in a side wall of said body and intersecting said longitudinal bore, and terminating in the opposite wall of the longitudinal bore;

iv. a sole stop member formed in said body, said stop member formed about said second opening, said stop member dimensioned to obstruct insertion of the rear end of the drive tool handle through the second opening and for non-rotational engagement of the tapered front region of the drive tool handle with the longitudinal bore, wherein a sufficient length of the cross-sectional configurations of said bores are generally complementary in cross-sectional configuration and dimension for removable, non-rotational engagement of the drive-tool handle with either the longitudinal bore through said first opening or the transverse bore through said transverse opening; and wherein said drive tool handle is alternatively positionable in said handle by inserting the rear end or the tapered front region of the drive tool handle in said first opening, or by inserting the rear end of the drive tool handle in said transverse opening; and b. a drive-tool comprising a drive-tool handle, said drive-tool handle dimensioned and having a cross-sectional configuration complementary to the cross-sectional configurations of said bores.

6. The assembly of claim 5 wherein non-slippery material or gripping members are formed on the surface of the body.

7. The assembly of claim 5 wherein said drive tool is a screwdriver.

8. The assembly of claim 5 wherein the body has a cross-section shaped for hand gripping which is selected from the group consisting of annular, generally annular, and polygonal.

* * * * *